US005366511A

United States Patent [19]

Holfeld et al.

[11] Patent Number: 5,366,511

[45] Date of Patent: * Nov. 22, 1994

[54] WOOL DYEING UTILIZING CONTROLLED DYE ADDITION

[75] Inventors: Winfried T. Holfeld; Dale E. Mancuso, both of Wilmington, Del.

[73] Assignee: E. I. Du Pont de Nemours and Company, Wilmington, Del.

[ * ] Notice: The portion of the term of this patent subsequent to Jul. 24, 2010 has been disclaimed.

[21] Appl. No.: 68,883

[22] Filed: May 28, 1993

Related U.S. Application Data

[63] Continuation-in-part of Ser. No. 884,500, May 15, 1992, abandoned.

[51] Int. Cl.[5] ..... D06P 5/00

[52] U.S. Cl. ..... 8/400; 8/504; 8/676; 8/680; 8/917

[58] Field of Search ..... 8/400, 504, 917, 676, 8/680

[56] References Cited

U.S. PATENT DOCUMENTS

| | | | |
|---|---|---|---|
| 3,710,601 | 5/1971 | Blanc et al. | 68/18 C |
| 3,738,803 | 6/1973 | Blanc et al. | 8/93 |
| 3,932,127 | 1/1973 | D'Albignac | 8/173 |
| 3,966,406 | 6/1976 | Namiki et al. | 8/179 |
| 4,125,371 | 11/1978 | Beutler et al. | 8/176 |
| 4,351,076 | 9/1982 | von der Eltz et al. | 8/149.1 |
| 4,483,032 | 11/1984 | Christ et al. | 8/149.1 |
| 4,502,865 | 3/1985 | Back et al. | 8/543 |
| 4,629,465 | 12/1986 | Hasler et al. | 8/400 |
| 4,820,312 | 4/1989 | von der Eltz | 8/533 |
| 4,885,814 | 12/1989 | von der Eltz | 8/149.1 |
| 5,230,709 | 7/1993 | Holfeld et al. | 8/400 |

FOREIGN PATENT DOCUMENTS

| | | |
|---|---|---|
| 2624176 | 12/1983 | Germany . |
| 2823543 | 11/1987 | Germany . |
| 1299777 | 12/1972 | United Kingdom . |

OTHER PUBLICATIONS

E. Merian and U. Lerch, American Dyestuff Reporter, 695–702, Sep. 17, 1962.

R. McGregor, Canadian Textile Journal, 61–68, May 1973.

W. Holfeld & M. Shephard, Textile Chemist and Colorist, a reprint from vol. 10, No. 2–3, Feb. and Mar., 1978.

H. Heilweil, TRI Notes on Research, No. 414, Jul., 1988.

J. Cegarra, P. Puente, J. Valldeperas, and M. Peio, Textile Research Journal, 645–653, Nov., 1988.

*Primary Examiner*—Paul Lieberman

*Assistant Examiner*—Margaret Einsmann

[57] ABSTRACT

A process for the dyeing of a fibrous article containing wool with an anionic dye and products processed thereby. The process includes immersing the article in a dyeing bath of a liquid solvent for the anionic dye. The liquid solvent and the article are heated to a temperature at least equal to the dyeing transition temperature. At least a portion of the dye is added as a miscible liquid concentrate while the solvent and the article are up to temperature. Stirring of the bath during the dye addition period and while the solvent and article are up to temperature is done to mix the dye concentrate with the solvent to form a dilute dye solution and to provide a flow of the dilute dye solution relative to the article to cause, on the average, essentially uniform dye transport of the anionic dye to the article. The dye addition rate is adjusted so that the dye addition rate is the primary control over the rate of dye uptake by the article.

7 Claims, No Drawings

WOOL DYEING UTILIZING CONTROLLED DYE ADDITION

The present invention is a continuation-in-part of application Ser. No. 07/884,500, filed May 15, 1992 now abandoned.

BACKGROUND OF THE INVENTION

The present invention relates to the dyeing of fibrous articles containing wool with anionic dyes.

Anionic dyes such as acid dyes and pre-metallized dyes are widely used for the dyeing of wool. In conventional dyeing processes using such dyes, articles containing wool are immersed in an aqueous bath containing a solution of the dye after any pre-treatment processes such as scouring. While a wide variety of dyeing equipment is used, it is typical for all of the dye to be used in the process to be present in the bath initially. The bath containing the dye and the article to be dyed is also usually at a low initial temperature, e.g., 80°–120° F. (26.7°–48.9° C.) and the temperature is increased gradually to an elevated temperature often as high as the boiling point as the dyeing progresses. "Metallizing" treatments with, e.g., with potassium dichromate, are often performed subsequently to dyeing to increase dye light and/or wash fastness.

While high quality dyeing can be achieved using the conventional dyeing process for some acid dyes such as small molecule "levelling" dyes, dye cycles to achieve levelling with such anionic dyes are sometimes extremely long and are therefore costly. In addition, long dye cycles are undesirable since the maintenance of the bath at a high dyeing temperature for a long period of time can decrease the strength of wool. It is very common to dye wool using large molecule acid and pre-metallized dyes which are desirable for applications requiring good light and/or wash fastness. However, undesirable dyeings can result with conventional dyeing processes using large molecule acid and pre-metallized dyes since individual wool fibers may not dye uniformly. Often, one end of a fiber will dye readily while the other end will absorb little dye resulting in a "skittery" dyeing in the article, i.e., noticeable localized dark/light areas.

Large molecule acid and pre-metallized dyes are often referred to as "structure sensitive" dyes since non-uniform dyeing can result from minor variations in the fiber physical structure. While dye-levelling and/or retarding agents can be added to the dye bath to improve dyeing uniformity with structure sensitive dyes, such agents sometimes provide only limited increases in dye uniformity and usually have disadvantages including increased initial expense and higher cost to treat the spent dyeing bath. In addition, because of their retarding effect, such chemical agents can sometimes increase dyeing cycles or make it difficult to obtain deep colors or dark shades. Also, dye yields from anionic dyes, i.e., the strength of color produced from a given quantity of dye on the fiber, are sometimes not as high as desired.

SUMMARY OF THE INVENTION

The invention provides an improved process for the dyeing of a fibrous article containing wool with at least one anionic dye and dyed products made by the process. A process in accordance with the invention includes immersing said article in a liquid bath of either an aqueous solvent medium or substantially nonaqueous solvent medium for the anionic dye. The bath and article are heated to a temperature at least equal to the dyeing transition temperature of wool. Anionic dye is added to the dyeing bath as a liquid concentrate with at least 33% of the total dye to be applied during the process being added while the bath and the article are at a temperature at least equal to the dyeing transition temperature. The bath is stirred as the liquid concentrate is being added to the bath to mix the concentrate with the solvent in the bath to form a dilute dye solution and to provide a flow of the dilute dye solution relative to the article to cause the dye to be transported to the article. The stirring further provides, on the average, essentially uniform dye transport of the anionic dye to the article. The dye is added to the bath so that the dye addition rate is the primary control over the rate of dye uptake by the article.

In one form of the invention, the dye is added to the bath at a dye addition rate of about 0.0005 to about 0.5% dye/minute based on the weight of the article.

In another form of the invention in which the process is performed in a dyeing machine in which the stirring provides repetitive machine cycles, the dye is added to the bath at a dye addition rate such that between about 0.04% and about 7% of the total dye to be applied during said process is added to said dyeing bath during a machine cycle.

The invention is useful in a wide variety of wool dyeing processes using anionic dyes. Surprisingly, it has been found that when used under conditions such that the dyes transfer less than 10%, anionic dyes are utilized more effectively which can provide either better dye yields or the achievement of deep colors or dark shades which were otherwise difficult to obtain or were unobtainable. Also, dye cycles for all types of dyes can be substantially shortened which can decrease cost and decrease the strength loss which is known to occur in wool dyeings. Moreover, the improvements in dyeing are often achievable without the use of or by using lower concentrations of chemical levelling or other chemical agents which, in significant concentrations, can complicate treatment of spent dyeing bath liquids.

DETAILED DESCRIPTION

There are a wide variety of fibrous articles containing wool which can be dyed using the process of the invention including, for example, yarns, fabric, carpets and garments. Wool as stock can also be an article dyed by this process. Fabrics include the usual textile forms including woven, knitted, and non-woven varieties. The wool can be present in the article together with any of a variety of other synthetic or natural fibers. Typical of such articles are yarns made from a "blend" of wool with other fibers and fabrics and garments made from such yarns. The other fibers in such articles may or may not undergo dyeing as the wool is dyed in the process. In addition, the wool to be dyed may already contain the same or a different dye. For example, the process of the invention may be used for a dye "add" to get to "shade" with the fiber already containing most of the dye before the process is used.

The dyes used in the practice of the present invention are anionic dyes and dyeing of the wool is accomplished by uptake of the dyes through the association of the dye molecules with nitrogen-containing groups on the wool fiber. Most anionic dyes are members of the well-known class of "acid" dyes. Another type of anionic dyes is the type referred to as "pre-metallized" dyes which are the reaction products of, for example, chromium or cobalt and selected dyes. As will become apparent hereinafter, mixtures of two or more dyes are often used to achieve a desired shade. In this application, the word "dye" may be used to refer to a single dye or multiple dyes as in a mixture of dyes used in a dyeing process or on a dyed article. In processes using more than one dye such as in dye mixtures to achieve compound shades, a process is intended to be within the scope of the invention provided that at least one dye of compound shade is applied to an article in accordance with the invention.

In accordance with a preferred process in accordance with the invention, conditions are used in the dye bath so that anionic dyes transfer less than about 10%. Transfer is a measure of the propensity of anionic dyes to migrate from one dye site to another after being absorbed by the fiber. Transfer (reported as % transfer) under a given set of conditions can be measured in a mock dye bath as in the transfer test method described hereinafter.

Providing transfer of less than 10% can easily be accomplished by use of dyes from a preferred class of dyes, the "structure sensitive" anionic dyes. These dyes are usually large molecule acid ("milling") dyes or premetallized dyes which are non-levelling, i.e., the dye molecules do not "transfer" significantly and thus migrate very little from one dye site to another after being absorbed by the fiber. Typically, structure sensitive dyes "transfer" less than 10% under normal conditions of use. "Structure sensitive" is the term applied to such dyes since non-uniform dyeing can result from even minor, and otherwise undetected, variations in the fiber physical structure. Such variations occur naturally in wool. Despite their known difficulties in use, structure sensitive dyes are desirable for many applications due to their washfastness, lightfastness, or both.

Without intending to limit this preferred form of the invention to these specific dyes, commonly used structure-sensitive dyes are represented, for example, by the list provided below (C.I. refers to the Color Index, 3rd edition, 1971):

C.I. Acid Yellow 220
C.I. Acid Orange 162
C.I. Acid Brown 282
C.I. Acid Brown 283
C.I. Acid Brown 226
C.I. Acid Red 407
C.I. Acid Red 251
C.I. Acid Black 60
C.I. Acid Blue 317
C.I. Acid Blue 80
C.I. Acid Blue 171
C.I. Acid Blue 336
C.I. Acid Black 172

For dyes which are normally described as "levelling" dyes since they transfer readily and "level" under the normal conditions of use, transfer of less than about 10% can be accomplished using conditions of low pH (high acidity in nonaqueous mediums), low temperature, or both. In addition, with dyes which are normally strongly levelling, it may be necessary to perform the dyeing rapidly even though the conditions in the dyeing bath are such that the dye transfers less than about 10%. Otherwise, the dye yield benefits which are otherwise obtainable using the invention may be diminished due to dye transfer which occurs after the dye is on the article.

As in conventional dyeing processes, it is desirable to scour the article, before dyeing to remove sizing and other materials which may adversely affect the dyeing. The fabrics can be scoured, for example, in an open width scouring range or in the apparatus to be used for the dyeing, e.g., a beck or paddle dyer. Scouring solutions used conventionally are generally suitable, e.g., water at 160°- 180° F. (71.1°-82.2° C.) containing a surfactant such as 0.5 gram/liter of MERPOL LFH® (a liquid non-ionic detergent sold by E. I. du Pont de Nemours & Company, Inc. of Wilmington, Del.). After scouring, the fabric should be rinsed such as by being immersed in hot water.

In the process of the invention, the article to be dyed is immersed in a dyeing bath containing a liquid solvent medium for the anionic dye. The dyeing bath can take a wide variety of forms in which the article is totally immersed in the bath throughout the dyeing process or is partially immersed at any one time and is moved in a cyclical or random fashion to provide contact for the entire article with the solvent. Partial immersion is useful for articles such as fabrics where the fabric can be progressively advanced through the bath, either in continuous rope form or by reciprocation of an article having a discrete length, so that the entire article is ultimately dyed. A preferred process employs the bath formed in a beck dyer for fabric in which the fabric is in the form of an endless rope and is moved by the action of the winch-reel. Most preferably, a beck for use in accordance with this invention is modified to include a pump and appropriate piping for external circulation of the solvent. Jet dyers are advantageously used for wool blend fabrics such as wool/polyester blends.

The liquid solvent medium for the dye can be an aqueous or nonaqueous medium which is a suitable solvent for the dye, which is capable of transporting the dye to the dye sites on the fiber and which is otherwise compatible with the fabric, dye and other aspects of the process.

Preferably, the liquid solvent is an aqueous liquid which contains less than about 10% by weight of additives. Possible additives include chemicals used for establishing and maintaining the desired pH. Other additives can be chemicals such as levelling agents, retarders, and the like which are referred to collectively in the present application as "dyeing auxiliaries".

If the solvent medium is substantially nonaqueous, the medium preferably comprises about 10% by volume of a water-miscible alcohol selected from the class consisting of methanol, ethanol, ethylene glycol, propylene glycol and mixtures thereof. Preferably, the solvent medium comprises at least about 90% by volume of one or a mixture of these water-miscible alcohol. A preferred embodiment of the invention employs a bath of 100% methanol containing only the chemical additives necessary or desirable for the dyeing.

By "substantially nonaqueous" is meant that the solvent medium contains less than about 10% water by volume. With ethanol, for example, it is difficult to entirely eliminate water if the solvent medium is recycled by distillation since ethanol forms an azeotrope at a ratio of ethanol to water of about 95/5. At least some of the water typically held in the wool fiber will likely be introduced into the bath during dyeing.

The remainder of the substantially nonaqueous solvent medium for the dye can be any of a variety of nonaqueous liquids provided they are otherwise compatible with the fabric, dye and other aspects of the process. These nonaqueous liquids may function as solvents for the dye. Alternately, the dye may only be insoluble or only slightly soluble in these liquids which will then act merely as diluents for the water-miscible alcohol or other solvents if other dye solvents are present. Preferably, all of the non-aqueous liquids of the solvent medium are miscible with each other and with the water-miscible alcohols so that a one-phase dyeing bath is provided.

Similar to processes for dyeing wool in an aqueous dyebath, it is generally necessary for the substantially nonaqueous bath to be acidic. Suitable acids to provide acidity in the dyebath include organic acids such as acetic acid or formic acid.

Dyeing auxiliaries can be present in the process of the invention although such agents often are not needed. If dyeing auxiliaries are present in the bath, a much lower concentration is typically used to keep the dye cycle to a reasonably short duration. Dyeing auxiliaries can be useful and may be desirable for compound shades of dyes of differing affinities.

When the bath has low levels of or is substantially free of dyeing auxiliaries, significant advantages are obtained in the treatment or disposal of the spent dye liquors. Moreover, the dyed fiber may be substantially free of residual dyeing auxiliaries or such agents may be present only at much lower levels than in fibers dyed by the conventional process for structure sensitive dyes which typically require high bath concentrations of dyeing auxiliaries. In addition, it is possible in some instances to use the spent dyeing bath for after-treatments such as for improving wetfastness, lightfastness or softness, applying antistats, and for other known after-treatments employing chemical agents. Metallizing can usually be done in the same bath. For such after-treatments, the chemical agent can be added to the hot bath using a technique similar to that used to add the dye in a process in accordance with the invention. In addition, it is also possible to reuse the spent bath in a subsequent dyeing if dyeing auxiliaries are absent or are present in sufficiently low concentration.

The anionic dye is added to the dyeing bath as a liquid concentrate at a controlled dye addition rate during a dye addition period. "Dye addition period" refers to the time period beginning with the first addition of dye and ending with the final amount of dye being added. The length of the dye addition period will usually range between about 5 minutes and about 4 hours with typical dye addition periods being between about 20 and about 100 minutes. Upon stirring as will be explained in more detail, the liquid dye concentrate is mixed with the solvent in the bath to form a dilute dye solution.

"Liquid concentrate" is intended to refer to a solution in which the dye is fully dissolved and which can be added to and mixed with the liquid solvent in the bath to form a dilute liquid solution of the dye. Preferably, if the solvent medium is substantially nonaqueous, the liquid concentrate is miscible with the bath solvent medium in all proportions of such concentrates which would normally be mixed into a dye bath. The solvent for the liquid concentrate can be different from the liquid solvent medium in the bath provided that the introduction of a different solvent does not otherwise adversely affect the dyeing process. When an aqueous dyeing bath is used, the solvent preferably used in the miscible liquid concentrate is water.

As will be explained in more detail hereinafter, the dye addition rate is adjusted depending on the amount of dye to be applied, the characteristics of the article to be dyed, the type of dyeing apparatus, the type of dye and the conditions of the dyeing to achieve the desired results. Preferably, to facilitate control over the process and make the process more easily reproducible, the dye is added continuously and at a constant rate during the dye addition period.

In processes in which the dilute dye solution in the bath is circulated by means of a circulation pump, the liquid dye concentrate is preferably added to the solvent ahead of the circulation pump. A metering pump is advantageously utilized for this purpose. When dyeing wool fabrics such as wool/polyester blend fabrics which can be dyed in a jet dyer, the circulation pump supplies the dilute dye solution to the jet nozzle so that the newly-added dye contacts the fabric first in the jet.

In a process in accordance with the invention, the dye bath containing the solvent and the article in the dyeing bath are heated to a temperature at least equal to the dyeing transition temperature. For the purposes of this application, dyeing transition temperature refers to the temperature during dyeing with a particular dye at which the wool fiber structure opens up sufficiently to allow a marked increase in the rate of dye uptake. The dyeing transition temperature for a dye/fiber combination may be determined by running the test method given hereinafter. The temperature at 15% exhaust is the dyeing transition temperature. If more than one dye is to be used in a dyeing process, the temperature in the dyeing process is preferably at least equal to the dyeing transition temperature of the dye having the highest dyeing transition temperature (usually also the most structure sensitive). In the preferred form of the invention using a beck dyeing apparatus modified to include a pump for external circulation of the bath liquid, heating can be achieved using a heat exchanger through which liquid from the bath is circulated externally.

In a process in accordance with the invention, at least a portion of the dye is added while the solvent and the article are at a temperature at least equal to the dyeing transition temperature. This part of the dyeing process can be referred to as the "rapid dye uptake phase", i.e., the time period where there is dye in the bath and the solvent and article are at a temperature at least equal to the dyeing transition temperature. In a process where no dye is added to the bath until the solvent and article are at least equal to the dyeing transition temperature, the rapid dye uptake phase will begin when dye is first added to the bath. In a process where dye addition is begun before the bath is up to temperature, the rapid dye uptake phase will begin when the solvent and article reach a temperature at least equal to the dyeing transition temperature. In typical processes, the rapid dye uptake phase will end when the bath is exhausted toward or at the end of the dyeing process.

During the rapid dye uptake phase in one preferred process in accordance with the invention, the temperature of the bath and the article in the bath is maintained generally constant so that the dyeing process is not affected by temperature changes which may affect the rate of dye uptake by the article. Generally, provided that the temperature remains above the dyeing transition temperature, the temperature should be controlled to within $\pm 10°$ C., preferably $\pm 5°$ C. Also, in aqueous systems, it is usually preferable for the pH to be maintained generally constant. It has been found that controlling the pH to within about $\pm 0.2$ units is suitable. In substantially nonaqueous systems, it is usually preferable for the acidity to be maintained generally constant.

In some processes, particularly processes using a dye mixture where one dye is structure sensitive and the other is strongly levelling, it may be desirable to decrease the pH (increase the acidity in substantially nonaqueous systems) and/or lower the temperature as the dyeing progresses to promote the exhaustion of the levelling dye from the bath. This is usually desirable towards or at the end of the dyeing since the structure sensitive dye may strike too fast and cause an unlevel dyeing if the pH or temperature is too low initially. Decreasing the pH (or increasing the acidity) can be done by metering a suitable acid solution such as acetic acid into the bath after the dye addition period or in aqueous mediums by using an acid donor such as the acid donor sold by Sandoz Chemical Co. under the trademark SANDACID V® which hydrolyzes and lowers pH in a gradual, controlled manner. Acid can also be metered into the bath together with the addition of dye.

In a process in accordance with the invention, at least about 33% of the dye is added to the bath when the solvent and the article are at least equal to the dyeing transition temperature, i.e., during the rapid dye uptake phase. Most preferably, at least about 50% of the dye is added during the rapid dye uptake phase. Increasing dye yield benefits will be obtained with increases in the amount of dye added during the rapid dye uptake phase. However, it may be desirable to forgo some of the dye yield increase to take advantage of decreased cycle time which may be obtained by adding at least some of the dye into the bath before it is up to the dyeing transition temperature.

Stirring of the bath during the dye addition period and the rapid dye uptake phase is done to mix the dye concentrate with the solvent in the bath to form a dilute dye solution and to provide a flow of the dilute dye solution relative to the article to cause the dye to be transported to the article. The term "stirring" is intended to include any means of mixing and imparting relative motion between the article and the solvent in the dyeing bath. The relative motion between the article and the solvent can be imparted by circulating the solvent in the dye bath, moving the article in the solvent, or both moving the article and circulating the liquid. In a preferred process employing a beck dyeing apparatus, both the article is moved and the bath liquid is circulated by action of the rotating winch-reel. For beck dyers, it may be desirable to have a pump for external circulation of the bath liquid into which the dye concentrate can be added to facilitate mixing. It is most preferable for the dye concentrate to be added to the bath liquid ahead of the pump.

The stirring also provides, on the average, essentially uniform dye transport of the anionic dye to the article during the dye addition period and rapid dye uptake phase so that a dyeing results which is sufficiently visually level to be useful for the intended purpose. Typically, a visually level fabric has shade variations across the fabric which are less than about 5%. Thus, during a process in which there are a number of repetitive cycles as in the preferred form of the invention in a beck dyer where the fabric rope cycles numerous times, the dye transport to the fabric may not be uniform in any one machine cycle. However, the additive effect of dye transport during all of the cycles is such that a level dyeing results since dye transport "on the average" is essentially uniform. As will become more apparent hereinafter, it may be desirable to increase the turnover rate, limit the dye addition rate, or both to decrease the percentage of total dye added per cycle and thereby increase uniformity due to the greater averaging effect obtained. To facilitate control over the process and to enable a process to be repeated, it is preferable for stirring to be performed constantly and at a constant rate.

In accordance with the invention, the dye addition rate is adjusted to be the primary control over the rate of dye uptake by the article at least while the solvent and the article are at or above the dyeing transition temperature. The type of adjustment of the dye addition rate necessary to accomplish this may be better understood by reference to Equation I which takes into account factors impacting the dyeing process:

$$L = \frac{D_s}{K \cdot D_f} \times \frac{r}{\delta} \qquad \text{I}$$

In Equation I, Ds is the diffusion coefficient of the dye in solution, Df is the diffusion coefficient of the dye in the fiber, K is the equilibrium distribution coefficient for the dye-fiber system, r is the radius of the fiber, and $\delta$ is thickness of the diffusional boundary layer. In a process in accordance with the invention, it has been discovered that adjusting the rate of dye addition into the bath and coordinating the rate with other conditions in the bath so that the rate of dye addition is the primary control over the rate of dye uptake provides low values for L in Equation I. It has further been discovered that the maximum benefits of the invention result when L is very low, preferably approaching zero.

To cause the rate of dye addition to be the primary control over the rate of dye uptake and thereby provide low L values, the rate of dye addition is limited so that the fibrous article, which is readily capable of accepting dye since it is above the dyeing transition temperature, is capable of accepting more dye than is supplied to it. Under these conditions, the concentration of dye in the bath is very much lower than in a conventional process and the influence of the diffusion coefficient in the fiber, Df, is therefore substantially less significant than in a conventional process. Also, the value for $Ds/(K.D_f)$ will be smaller than in a conventional process and will lead to lower L values, primarily because the value for K will increase as the concentration of dye in the dye bath decreases. This effect is particularly pronounced in the preferred form of the invention where dyes are used and/or conditions established so that the dyes transfer less than about 10%. In such cases, the value for K is very high and is further increased by the limited concentration of dye in the bath.

Rates of dye addition in accordance with one form of the invention based on the fabric weight are about 0.0005 to 0.5% dye/minute. The rates at the lower end of the range are useful for low percent dye-on-fiber dyeings with extremely high affinity dyes to provide a sufficient number of machine cycles for adequate averaging to provide essentially uniform dye transport.

In another form of the invention as in commercial processes employing a number of repetitive machine cycles, e.g., turnovers of the fabric in a beck dyer or circulation of the bath in a package dyer, the rate of dye addition is such that an amount of dye between about 0.04% and about 7% of the total dye to be applied is added in a machine cycle to achieve, on the average, essentially uniform dye transport and a visually level dyeing in accordance with the invention. Most preferably, an amount of dye between about 0.5% and about 3% to be applied is added during a machine cycle. Using laboratory dyeing equipment, percentages of total dye per cycle are typically lower since laboratory equipment usually has a high turnover rate which would not be practical for use in large commercial dyeing equipment although excellent results are obtained.

Using the preferred process of the invention in which conditions are used so that the dyes transfer less than 10% in the same equipment used for conventional wool dyeings, articles containing wool can be produced with a higher relative dye strength for the same relative dye content, i.e., to have a higher relative dye yield, than can be obtained using conventional processes. Depending on the type of dye being used, the temperature and pH (acidity) conditions in the dyebath can be used to adjust the relative dye yields obtained for a process of the invention in the same type of equipment under the same conditions. For example, with most anionic dyes, decreasing the pH (increasing the acidity) will provide increases in relative dye yields. For dyes which level under conventional conditions, it may be desirable to employ lower temperatures which has the primary effect of decreasing transfer. With increased temperatures above the dye transition temperature, relative dye yields provided by many structure sensitive dyes may increase. However, in general, conditions which produce the maximum benefits in terms of dye yield with structure sensitive dyes may make it more difficult to obtain a visually level dyeing. Accordingly, it may be necessary to select conditions which provide a compromise between relative dye yield increases and still provide a level dyeing without extraordinary care.

The preferred process of the invention using dyes under conditions such that the transfer is less than 10% is capable of minimizing the sensitivity to structural differences in the fibers which can lead to non-uniform dyeing. Provided that the transport of the dye to the article is, on the average, essentially uniform, a more visually level dyeing can be achieved than is normally achieved using a conventional process since individual fibers are dyed more uniformly in a process in accordance with the invention.

It is also possible to adjust the results of the invention by including dyeing auxiliaries in the solvent in the dye bath or including them in the dye concentrate. In general, auxiliaries which decrease the strike rate of the dye will decrease the relative dye yield obtained and the dyeing will be more like a conventional dyeing. In addition, where the dye is added into the bath before the bath has reached its dyeing transition temperature, the dye which is absorbed by the fiber before the dyeing transition temperature is reached will impart some conventional dyeing characteristics to the fiber in the article.

For setting up a commercial process in accordance with the invention, it is advantageous for the process to be run first in laboratory scale equipment corresponding generally to the chosen process conditions. In the laboratory scale process, a dye addition rate can thereby be determined in advance or a rate based on past experience for the same or similar dyeings can be confirmed. Due to smaller ratios of the weight of the bath to the weight of the goods and particularly the lower turnover rates in larger scale dyers compared to typical laboratory dyers, the dye addition rate or conditions used may have to be further modified for successful larger scale dyeings.

In the preferred form of the invention, it is usually only necessary to carefully control the process during the rapid dye uptake phase and, at most other times during the process, temperature and other bath conditions need not be as carefully controlled. For example, elevating the bath to the desired temperature can be done quickly and pH (or acidity in substantially nonaqueous mediums) adjustment prior to dye addition can be done expeditiously and without the degree of care required in the conventional process for dyeing wool. This is particularly advantageous since, with only one critical stage and when constant temperature and pH (acidity) are employed, the procedure will be easily reproducible and it will be possible to efficiently make repetitive dyeings of the same fabric. Moreover, in the event that it is discovered early in a dyeing process that the conditions in the bath are not as desired, the dye addition can be stopped and the desired conditions established before the dyeing is resumed.

After the dyeing is complete, the dyeing bath is cooled if necessary and dropped. For nonaqueous mediums, the bath is cooled if necessary and transferred typically to another vessel for solvent medium recovery. The article can be rinsed, dried and subsequently used in a conventional manner.

Improvements in dye yield are due to the distribution of dye in the dyed articles. The wool fiber adjacent to the outside surfaces yarns contain more dye than filaments in the interior of the yarn. In addition, the wool fibers are asymmetrically ring-dyed, i.e., the fibers are dyed with more dye being present adjacent to the surface of the fibers than in the interior but the ring-dying of at least some of the fibers is asymmetric, i.e., more dye being present on one side or the other. The fabrics dyed by the process have more dye on yarns adjacent to the surfaces of the fabric than in the interior of the fabric which is different from the more uniform distribution obtained using conventional processes.

While the dye may be non-uniformly distributed in the fabric, fabrics made using the invention can be visually level and are highly uniform. Although the invention is applicable to other types of fabrics such as nonwovens and tufted fabrics used for carpeting, preferred fabrics in accordance with the invention are selected from the class consisting of knitted and woven fabrics. In addition, it is preferable for the fabric to be dyed with at least one structure sensitive anionic dye.

TEST METHODS

The Dye Transition Temperature is determined for a fiber/dye combination as follows:

A sample of the article is prescoured in a bath containing 800 g water/g of sample with 0.5 g/l of tetrasodiumpyrophosphate and 0.5 g/l of MERPOL HCS® (a liquid non-ionic detergent sold by E. I. du Pont de Nemours & Company). The bath temperature is raised at a rate of about 3° C./min. until the bath temperature is 60° C. The temperature is held for 15 minutes at 60° C., then the fiber is rinsed. (Note that the prescour temperature must not exceed the dye transition temperature of the fiber. If the dye transition temperature appears to be close to the prescour temperature, the procedure should be repeated at a lower prescour temperature.)

A bath (without the article) containing 800 g water is adjusted to 30° C. and 1% (based on the weight of the article) of the dye to be used and 5 g/l of monobasic sodium phosphate are added. The pH is adjusted to 5.0 using monobasic sodium phosphate and acetic acid. If the bath is substantially nonaqueous, a bath of the nonaqueous solvent medium to be used in the process under consideration is set (without the article). Acid of the same type and percentage to be used substantially nonaqueous bath is also added. A sample of the article which provides a 20–50 liquor ratio is added and the bath temperature is increased at a rate of 3° C./min to 95° C. for aqueous systems or within 5° C. of the boiling point for nonaqueous mediums.

With every 5° C. rise in bath temperature a dye liquor sample of ~25 ml is taken from the dye bath. The samples are cooled to room temperature and the absorbance of each sample at a wavelength known to be useful for monitoring the dye is measured on a spectrophotometer such as a Perkin-Elmer C552-000 UV-visible spectrophotometer (Perkin-Elmer Instruments, Norwalk, Conn. 06856) using a water reference.

The % dye exhaust is calculated and plotted with respect to dyebath temperature. The temperature at 15% exhaust is the dye transition temperature.

% Transfer can be determined using the AATCC Test Method 159-1989 (AATCC Technical Manual/1991, p. 285–286) except with the mock dyebath being at the same pH (acidity) and temperature of the process under consideration and a 30 minute time period are used. Percent transfer is calculated in this method by measuring the relative dye strength of the original dyed sample before (control, 100% relative dye strength) and after the transfer procedure. The difference is the % transfer.

Relative Dye Strength is a relative measure of the strength of dye in a fabric determined photometrically for a series of fabrics dyed with the same dye with the sample dyed by the comparative or control procedure being arbitrarily designated as having 100% relative dye strength.

Relative dye strength for a fabric sample is measured at the wavelength of minimum reflectance using a MACBETH COLOR EYE 1500 PLUS SYSTEM Spectrophotometer, sold by Macbeth Division of Kollmorgen Instrument Corp. of Newburg, N.Y. A scan from 750 to 350 nm can be performed to determine the wavelength of minimum reflectance for the dye. All subsequent samples in a series with the same dye are then measured at the same wavelength. For example, the wavelength of minimum reflectance for C.I. Acid Blue 122 is 640 nm.

The sample produced by the comparative or control procedure is designated the control and assigned a relative dye strength of 100%. The remaining samples are then scaled in relative dye strength by the following:

$$\text{Rel. Dye Strength (\%)} = \frac{K/S \text{ sample}}{K/S \text{ control}} \times 100,$$

and $$K/S = \frac{(1 - R)_2}{2R}$$

where: R=reflectance.

Relative Dye Content is a relative measure of dye content determined photometrically for a series of fabrics dyed with the same dye with the sample dyed by the comparative or control procedure being arbitrarily designated as having a 100% relative dye content.

The relative dye content is determined in the following way. First, a sample of the article is cut into small segments and about 0.1 gram is weighed to +0.1 mg accuracy. Typically, a test series of samples of dyed articles is weighed to each have very nearly the same weights. The samples are dissolved in 30 ml of an appropriate solvent at ambient temperature.

A Perkin-Elmer C552-000 UV-visible spectrophotometer (Perkin-Elmer Instruments, Norwalk, Conn. 06856) is used to record the absorbance of the samples. A scan from 750 to 350 nm is performed and the largest peaks are chosen as analytical wavelengths for the dye tested. All subsequent samples in a series with the same dye are then measured at these wavelengths. Typically, sample sizes around 0.1 gram give absorbance readings in the range of 0.3 AU to 0.8 AU for the dye levels obtained.

A corrected absorbance is calculated for each wavelength measured on every sample in the series. The corrected absorbance is:

$$A(\text{corrected}) = (S \times 0.1 \text{ gram})/W$$

where: S=absorbance at a given wavelength; and W=weight of sample in grams

The sample dyed by the comparative or control procedure is assigned a relative dye content of 100%. The remaining samples are then scaled in relative dye content by the following:

$$\text{Rel. Dye Content (\%)} = (A_s \times 100)/A_1$$

where: $A_s$=average absorbance of sample; and $A_1$=average absorbance of the control sample.

This calculation is performed for every analytical wavelength chosen in a given dye series.

Relative Dye Yield is defined as the ratio of the Relative Dye Strength to the Relative Dye Content:

$$\text{Rel. Dye Yield} = \frac{\text{Relative Dye Strength}}{\text{Relative Dye Content}}$$

The invention is illustrated in the following example which is not intended to be limiting. Percentages are by weight unless otherwise indicated.

EXAMPLE 1

Part A 30 grams of a scoured fabric, woven from 100% wool (35 cm×35 cm), is introduced into a Werner-Mathis Laboratory Dyeing Apparatus;, Type JF, sold by Werner-Mathis U.S.A., of Concord, N.C. The fabric is placed in the perforated basket and the see-through door is closed. The dyeing bath is then set with 1800 ml of distilled water at a 60:1 liquor ratio (weight of bath to weight of fabric) at 80° (26.7° C.) and then pH is adjusted to 5.0 with monosodium phosphate (MSP) and phosphoric acid. 0.15 g (0.5% on weight of sample) of ALBEGAL-B®, a wool leveling agent from Ciba-Geigy Corp., is added to the bath.

The basket device is set into motion by adjusting the rheostat driven motor so that the basket rotates in a clockwise motion for about six seconds; then stops for about five seconds; then reverses to a counter-clockwise motion for six seconds. This sequence of clockwise, pause, and counter-clockwise movements continues automatically throughout the dyeing procedure. This provides adequate movement of the bath liquor and the fabric sample to provide uniform application of dye to the substrate.

The temperature of the dyeing bath is then raised rapidly by 5° F./min. (2.8°/min.) or greater to the dyeing temperature. In this example, the dyeing temperature is held nearly constant at about 200° F. (93.3° C.) during the dye addition period as the dye is added as described below. (The rapid dye uptake phase of this example begins with the addition of dye during the dye uptake phase, i.e., 100% of the dye is added during the rapid dye uptake phase.)

Separately, 0.6 g of C.I. Acid Blue 336, a pre-metallized acid dye, is dissolved in 200 ml of distilled water to form a dye concentrate. The amount of dye used is calculated to provide 2% dye-on-fiber assuming complete exhaustion of the dye. Using a precision (approx. 1% accuracy) MANOSTAT COMPULAB® liquid metering pump sold by Manostat Corporation of New York, N.Y., the separately prepared dye solution is metered under the surface of the dyeing bath away from the moving fabric at the rate of 5 ml/minute which is equivalent to 0.05% dye/minute based on the weight of fabric. Under these conditions this dye transfers less than 10% and there is never any visible build-up of dye in the dyeing bath during the period of dye addition which is complete in 40 minutes. The dyeing bath is then cooled at 5° F./min. (2.81° C./min.) to 170° F. (76.6° C.), then the fabric is overflow rinsed, removed from the dyeing machine, then air dried.

The result obtained is a level blue dyeing on the woven wool fabric and a visually colorless dyeing bath.

Part B (Comparative)

30 grams of the fabric described above is introduced into the perforated basket in the JF machine as in the previous example. The dyeing bath is again set as in the previous example. Separately, 0.6 grams of C.I. Acid Blue 336, a pre-metallized acid dye, are dissolved in 200 ml of distilled water. All of the dye solution is then added to the dyeing bath in the conventional manner at 80° F. (26.7° C.). The dyeing bath is raised at 1° F. (0.6° C.) per minute to 205° F. (96.1° C.) and held for 45 minutes. The bath is cooled and the fabric rinsed and removed as in the previous example. The result obtained is a level blue dyeing on the woven wool fabric and a visually colorless dye bath.

Assuming the same relative dye content for the fabric dyed by the invention and the comparative example, reflectance measurements show that the relative dye yield is increased 15% in the sample dyed by the process invention compared to the conventional process of the comparative example.

EXAMPLE 2

In this example, 180 grams of a scoured woven wool fabric (30 cm×90 cm) is dyed in an 8 inch (20 cm) Saucier Beck-dyeing Machine, manufactured by Saucier Stainless Steel Products, Minneapolis, Minn. The fabric is placed over the winch of this beck, then sewn at the ends to form an endless "rope." The dyeing bath is then set with 25 liters of distilled water at 139:1 liquor ratio (weight of bath to weight of fabric) at 80° F. (26.7° C.) and then the pH is adjusted to 5.0 with monosodium phosphate (MSP) and phosphoric acid. 0.9 g (0.5% on weight of sample) of ALBEGAL-B®, a wool leveling agent from Ciba-Geigy Corp., is added to the bath. The fabric is set in motion by the turning action of the winch-reel. The temperature of the dyeing bath is then raised rapidly by 5° F./min. (2.8° C./min.) to the dyeing temperature. In this example, the dyeing temperature is held nearly constant at about 200° F. (93.3° C.) during the dye addition period as described below.

Separately 1.8 g of C.I. Acid Blue 336, a pre-metallized acid dye, is dissolved in 1000 ml of distilled water to provide ~1% dye-on-fiber assuming complete exhaustion of the dye. Using a precision (~1% accuracy) MANOSTAT COMPULAB liquid metering pump sold by Manostat Corporation of New York, N.Y., the separately prepared dye solution is metered under the surface of the dyeing bath away from the moving fabric at the rate of 25 ml/minute which is equivalent to 0.025% dye/minute based on the weight of the fabric. Under these conditions the dye transfers less than 10% and there is never any visible build-up of dye in the dyeing bath during the dye addition period which is complete in 40 minutes. Concentrations determined spectrophotometrically show that the concentration of dye in the bath at the after the dye addition has been in progress for 5 minutes ranges between about 5 and about 20 times the final equilibrium concentration which is reached after the dye addition is complete.

The dyeing bath is then cooled at 5° F./min. (2.8° C./min.) to 170° F. (76.7° C.), then the fabric is overflow rinsed, removed from the dyeing machine, then air dried.

The result obtained is a level blue dyeing on the wool fabric and a visually colorless dyeing bath.

What is claimed is:

1. A process for dyeing a fibrous article containing wool with at least one anionic dye comprising:

immersing said article in a liquid bath of a solvent medium for said anionic dye, said solvent medium being selected from the group consisting of aqueous solvent mediums and substantially nonaqueous solvent mediums;

heating said bath and said article in said dyeing bath to a temperature at least equal to the dyeing transition temperature of wool;

adding said anionic dye to said dyeing bath as a liquid concentrate, at least 33% of said total dye to be applied during said process being added while said bath and said article are at a temperature at least equal to said dyeing transition temperature; and stirring said bath as said liquid concentrate is being added to said bath to mix said concentrate with said solvent in said bath to form a dilute dye solution and to provide a flow of said dilute dye solution relative to said article to cause said dye to be transported to said article, said stirring further providing, on the average, essentially uniform dye transport of said anionic dye to said article;

said dye being added to said bath at an addition rate of about 0.0005 to about 0.5% dye/minute based on the weight of said article.

2. The process of claim 1 further comprising maintaining temperature and acidity in said liquid solvent so that said anionic dye transfers less than about 10%.

3. The process of claim 1 wherein at least about 50% of said dye is added while said solvent and said article are at a temperature at least equal to said dyeing transition temperature.

4. The process of claim 1 wherein said liquid solvent is an aqueous liquid.

5. A process for dyeing a fibrous article containing wool with at least one anionic dye comprising:

immersing said article in a liquid bath of a solvent medium for said anionic dye, said solvent medium being selected from the group consisting of aqueous solvent mediums and substantially nonaqueous solvent mediums;

heating said bath and said article in said dyeing bath to a temperature at least equal to the dyeing transition temperature of wool;

adding said anionic dye to said dyeing bath as a liquid concentrate, at least 33% of said total dye to be applied during said process being added while said bath and said article are at a temperature at least equal to said dyeing transition temperature; and stirring said bath as said liquid concentrate is being added to said bath to mix said concentrate with said solvent in said bath to form a dilute dye solution and to provide a flow of said dilute dye solution relative to said article to cause said dye to be transported to said article, said stirring further providing, on the average, essentially uniform dye transport of said anionic dye to said article;

said process being performed in a dyeing machine in which said stirring provides repetitive machine cycles;

said anionic dye being added to the bath at a dye addition rate such an amount of dye between about 0.04% and about 7% of the total dye to be applied during said process is added to said dyeing bath during a machine cycle.

6. The process of claim 5 wherein said dye addition rate is such that an amount of dye between about 0.5% and 3% of the total dye to be applied during said process is added during a machine cycle.

7. The process of claim 5 further comprising maintaining temperature and acidity in said liquid solvent so that said anionic dye transfers less than about 10%.

* * * * *